United States Patent [19]

Jones

[11] Patent Number: 4,678,135

[45] Date of Patent: Jul. 7, 1987

[54] CONTROL OF LINE WRAPPING ON REEL, BY REEL GROOVE DESIGN

[76] Inventor: Ralph W. Jones, 1025 Avondale Rd., San Marino, Calif. 91108

[21] Appl. No.: 768,204

[22] Filed: Aug. 22, 1985

[51] Int. Cl.[4] ..... B65H 75/14; B65H 75/18

[52] U.S. Cl. ..... 242/117; 242/118.4

[58] Field of Search ..... 242/77, 117, 47.5, 118.4, 242/118.41, 118.5, 118.6, 118.61, 118.62, 86, 96, 47, 86.1, 86.2, 86.3, 86.4; 254/266, 374

[56] References Cited

U.S. PATENT DOCUMENTS

| | | | |
|---|---|---|---|
| 1,202,718 | 10/1916 | Holmes | 242/86.2 X |
| 1,380,549 | 6/1921 | Flood | 242/86 |
| 1,746,995 | 2/1930 | Edwards | 242/86 X |
| 1,993,617 | 3/1935 | Nason | 242/107.7 X |
| 2,224,075 | 12/1940 | Cavanaugh | 242/118.4 |
| 2,250,269 | 7/1941 | Lockwood | 242/117 |
| 2,287,602 | 6/1942 | Campbell | 242/86 X |
| 2,449,376 | 9/1948 | Gahagan | 254/374 X |
| 2,855,717 | 10/1958 | Heil | 242/96 X |
| 2,907,534 | 10/1959 | Benstein | 242/86 |
| 3,150,844 | 9/1964 | Le Bus, Sr. | 242/117 |
| 3,162,993 | 12/1964 | Green | 57/303 |
| 3,175,783 | 3/1965 | Ketterer | 242/118.4 |
| 3,357,169 | 12/1967 | Bigiel | 57/70 |
| 3,645,469 | 2/1972 | Fischer et al. | 242/118.4 |
| 3,851,830 | 12/1974 | Barthalon | 242/7.03 |
| 4,196,864 | 4/1980 | Cole | 242/118.6 X |
| 4,354,645 | 10/1982 | Glavas et al. | 242/117 |

FOREIGN PATENT DOCUMENTS

| | | | |
|---|---|---|---|
| 990022 | 9/1951 | France | 242/118.6 |
| 834487 | 5/1960 | United Kingdom | 242/117 |

*Primary Examiner*—Stuart S. Levy
*Assistant Examiner*—Joseph J. Hail, III
*Attorney, Agent, or Firm*—William W. Haefliger

[57] ABSTRACT

Apparatus is provided for wrapping a line, the line having an average cross section dimension D, and includes a reel having an axis of rotation, a hub outer surface extending about said axis, and two axially spaced flange surfaces which face one another, outwardly of the reel surface, and across a groove defined between said flange surfaces and outwardly of the hub surface. The improvement includes:

(a) the groove having a width W, where 1.5 $D < W < 3\ D$, (b) the hub surface inclined relative to said axis to urge the line initial wrapping on the hub surface to a predetermined position.

7 Claims, 4 Drawing Figures

CONTROL OF LINE WRAPPING ON REEL, BY REEL GROOVE DESIGN

BACKGROUND OF THE INVENTION

This invention relates generally to reels for lines such as cable or line, and more particularly concerns reel configurations for controlling winding and unwinding of such lines.

When line is to be wound on a reel or drum, it is desired that the reeling or unreeling action be smooth, and that there be no binding of the line for maximum reel capacity. In small reels, the best examples of the problems and the solutions are to be found in fishing reels, where ingenuity has developed a variety of level-wind devices.

In another type of small reel, characterized as the spring-operated self-retracting reel, space and cost limitations have precluded the use of level-wind mechanisms. Attempts to build such reels have been plagued with problems of binding and unevenness as the line was dispensed and retrieved.

Consider, for example, the two possible extremes of line space: one, a wide, shallow drum on which line may be wound in random fashion; the other a narrow slit as wide as the line diameter, in which line may be wound in a stacked spiral. The former produces uneven action and binding unless the line is guided by a level-wind. The latter has extremely limited capacity. Somewhere between these two extremes lies a better reeling action, but the alternatives are limited.

For example to avoid binding when a line is unwinding from a reel, it must have been wound onto the reel in such a manner that (a) one wrap cannot get beneath a previous wrap, and (b) a wrap cannot wedge between two surfaces that provide a self-locking friction angle between them.

There is need for a simple reel configuration that will achieve a desired smooth dispensing and retrieval of line from a reel, such as a spring operated self-retracting reel.

SUMMARY OF THE INVENTION

It is a major object of the invention to provide a simple reel configuration meeting the above need, through shaping the space or groove in which the line is wound on the reel.

As will be seen, the invention is embodied in apparatus for wrapping a line, the line having an average cross section dimension D, and including a reel having an axis of rotation, a hub outer surface extending about said axis, and two axially spaced flange surfaces which face one another, outwardly of the reel surface, and across a groove defined between said flange surfaces and outwardly of the hub surface, the improvement comprising:

(a) the groove having a width W, where $1.5D<W<3D$, (b) the hub surface inclined relative to said axis to urge the line initial wrapping on the hub surface closer to one side of the groove than to the other.

As will be seen, the hub inclined surface typically smoothly merges annularly with one of the flange surfaces at a first annular location, and annularly merges with the other flange surface at a second annular location, the first location being closer to said axis than the second location; and the angle of hub surface inclination relative to the hub is between 20° and 40°, and is optimally about 30°.

These and other objects and advantages of the invention, as well as the details of an illustrative embodiment, will be more fully understood from the following specification and drawings in which:

DRAWING DESCRIPTION

DETAILED DESCRIPTION

Figure 1:
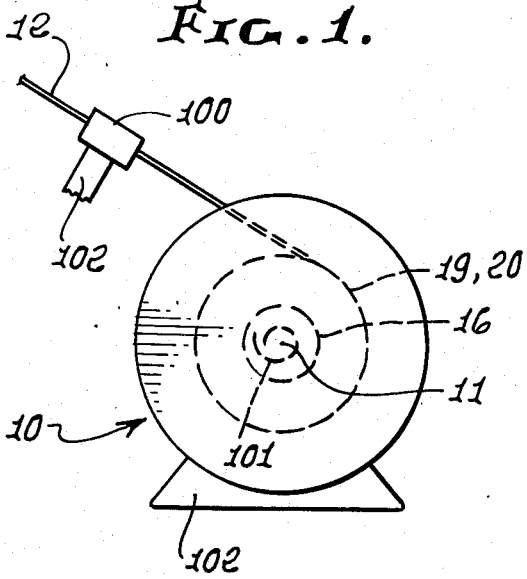
FIG. 1 is a side elevation showing a reel.

Referring first to FIG. 1, a reel is shown at 10, having an axis of rotation, or center line, at 11. It may be characterized as a spring-reel, i.e. spring operated, self-retracting, although the invention is applicable to other type reels. A fixed guide to guide the line 12 toward the reel from a fixed position is indicated at 100. A retracting spring is indicated in the hub, at 101.

As mentioned above, to avoid binding, when a line is unwinding from a reel, the line must have been wound onto the reel in such a manner that (a) one wrap cannot get beneath a previous wrap, and (b) a wrap cannot wedge between two surfaces that provide a self-locking friction angle between them.

Figure 2:
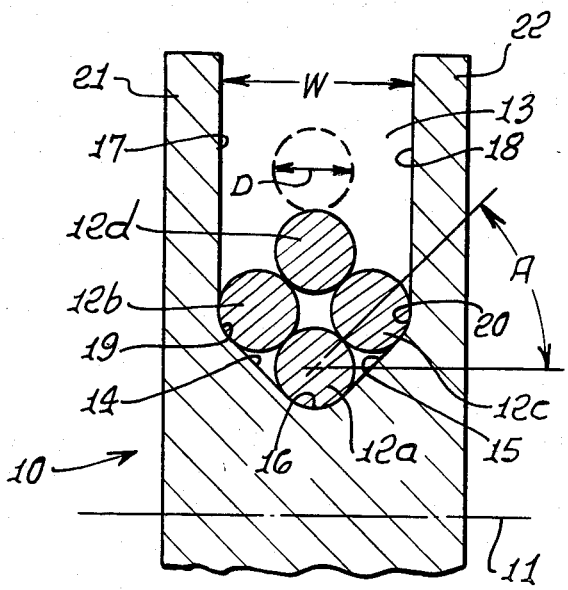
FIG. 2 is an enlarged cross-section through the FIG. 1 reel.

FIG. 2 shows one reel design for meeting the foregoing requirements more satisfactorily than with a stacked spiral and in which the first wrap 12 *a* is centered in groove 13. The next two wraps 12*b* and 12*c* ride on and straddle the first wrap, the fourth wrap 12*d* being centered in the groove by the two previous wraps, and so on.

In this design, the angle A can be no more than 60°, and the wedging angles are most favorable at that angle. The number of wraps per radial increment, however, increases as angle A is decreased to 30°. Below that angle, the stacking pattern is unstable.

As long as angle A is between 30° and 60°, if the line being wound on the reel is guided toward the center of the groove, it will automatically tend to lay in the groove in the pattern shown in FIG. 1, but with one exception. It is possible for the line to temporarily stack directly on top of a previous centered wrap. This creates an unstable condition which can collapse so that one wrap gets beneath a previous wrap, creating uneven action and binding. Note hub surfaces 14 and 15 angled at angle A relative to the axis 11, and tapered as shown. They merge at annular surface 16 which is outwardly concave to seat wrap 12*a*. Surfaces 14 and 15 smoothly merge at 19 and 20 with parallel walls 17 and 18 of flange 21 and 22. The groove width dimension W between flange walls, or surfaces 17 and 18, is $2D \leqq W < 2.75D$ where D equals the line diameter.

Figure 3:
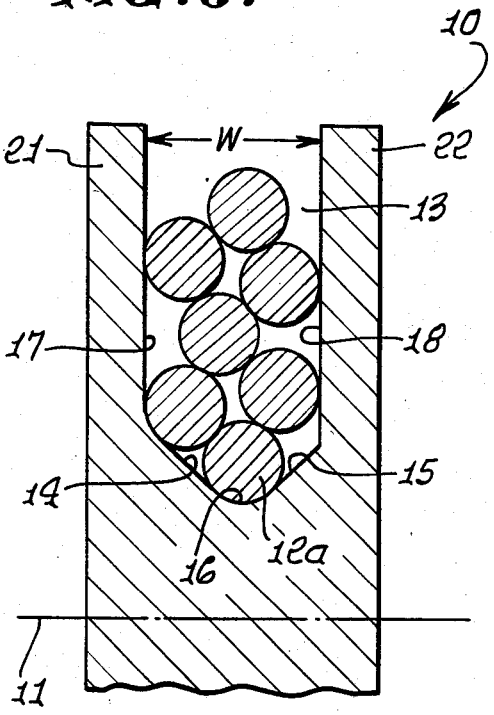
FIG. 3 is a view like FIG. 2 showing a modification.

The defect noted can be ameliorated somewhat by positioning the first wrap 12*a* slightly off-center in the groove, as shown in FIG. 3. Hub surface 16 is now closer to wall 18 than to wall 17. In this way, the single-wrap layer is caused to oscillate back and forth as it winds or unwinds, always slightly off-center in the groove, thus reducing the possibility of an unstable stacking and collapse. The possibility is not eliminated, however, as normal friction between wrapped layers can still cause temporary stacking.

Figure 4:
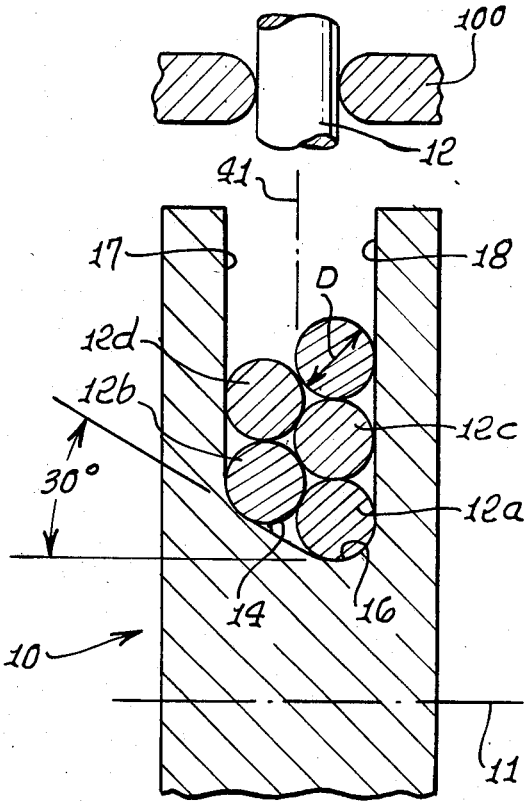
FIG. 4 is a view like FIG. 2, showing a preferred form of a reel and line configuration.

The best groove shape and winding pattern for a line reel in which the line approaches from a fixed guide is that shown in FIG. 4. With this design, the friction angles between line wraps are such that successive wraps are positively urged to overcome normal friction and fall into their assigned positions, without binding or overlapping. It also provides twice as much capacity per raidal increment as is possible with a groove one line diameter in width.

The dimensional characteristics of the reel groove shown in FIG. 4 are the following:

1. Groove width W is approximately 1.87 times line diameter.
2. The bottom surface 14 of the groove is inclined at 30° from the axis of the reel, so as to throw the first wrap of the line to one side of the groove, as shown.
3. The line to be wound in the groove is guided to the center of the groove width from as close as possible to the outside diameter of the reel. See guide 100, in FIGS. 1 and 4.

Note that surfaces 14 and 18 now merge, annularly, at 16, offset from the center-line 41 of the groove. Also, successive turns of the windings, as at 12*c* and 12*d*, are located adjacent alternate of the flange surfaces, i.e. 18 and 17.

For purposes of definition, the word "line" shall be understood to include cord, string, cable, chain or filament of essentially circular cross-section. It may have an average or nominal diameter D.

Structure mounting both the reel 10 and the guide 100 is indicated at 102, the reel being mounted for rotation. As shown, the line guide 100 defines line guiding shoulders in alignment with the groove and spaced at equal distances from the plane 41 in FIG. 4 normal to axis 11 and bisecting the groove.

I claim:

1. An apparatus for wrapping a line, the line having an average cross section dimension D, and including a reel having an axis of rotation, a hub outer surface extending about said axis, and two axially spaced flange surfaces which face one another, outwardly of the reel surface, and across a groove defined between said flange surfaces and outwardly of the hub surface, the improvement comprising:

(a) said groove having a width W, where $W=1.87\ D$, (b) said hub surface inclined relative to said axis to urge the line initial wrapping on the hub surface to a predetermined position, (c) and including said line and a line guide aligning the line with and guiding the line toward the center of the groove as the line winds into said groove, the line guide defining an opening passing the line, said opening having width in the direction of W, and which is less than W and close to D.

2. The apparatus of claim 1 wherein said hub inclined surface smoothly merges annularly with one of the flange surfaces at a first location, and annularly merges with the other flange surface at a second annular location, the first location being closer to said axis than the second location.

3. The apparatus of claim 1 wherein said hub surface is angled at between 30° and 60° relative to said axis, the line having circular cross section, and defining windings about said axis, two windings engaging said hub surface at locations in a plane which contains the reel axis and extends radially.

4. The apparatus of claim 1 wherein said hub surface is angled at about 30° relative to said axis.

5. The apparatus of claim 4 wherein said line is wound in said groove with successive turns of the winding located adjacent alternate of said flange surfaces.

6. The apparatus of claim 1 wherein said line has a substantially circular cross section.

7. The apparatus of claim 1 wherein the line guide defines line guiding shoulders in alignment with the groove and spaced at equal distances from a plane normal to said axis and bisecting the groove.

* * * * *